United States Patent [19]

Smith

[11] 4,267,501

[45] May 12, 1981

[54] NMOS VOLTAGE REFERENCE GENERATOR

[75] Inventor: Stephen L. Smith, Tempe, Ariz.

[73] Assignee: Motorola, Inc., Schaumburg, Ill.

[21] Appl. No.: 50,729

[22] Filed: Jun. 21, 1979

[51] Int. Cl.[3] ..... G05F 1/56

[52] U.S. Cl. ..... 323/313; 307/297; 307/304; 330/253

[58] Field of Search ..... 323/16, 19, 22 R; 330/253, 259-261; 307/279, 297, 304

[56] References Cited

U.S. PATENT DOCUMENTS

| | | | |
|---|---|---|---|
| 3,743,923 | 7/1973 | Steudel | 323/22 R |
| 3,970,875 | 7/1976 | Leehan | 323/22 R |
| 3,970,951 | 7/1976 | Hoffman | 330/253 |
| 4,158,804 | 6/1979 | Butler et al. | 323/22 R |

*Primary Examiner*—William M. Shoop
*Assistant Examiner*—Peter S. Wong
*Attorney, Agent, or Firm*—Vincent B. Ingrassia

[57] ABSTRACT

An NMOS voltage regulator circuit generates a reference voltage for comparison with, for example, TTL logic levels. A resistive voltage divider coupled to a 5 volt source produces a voltage of, for example, 1.5 volts which is applied to the non-inverting input of a differential amplifier. The reference voltage appears at the inverting input of the differential amplifier. Field effect transistor means are provided to raise or lower the voltage at the inverting input depending on whether a negative or positive excursion has taken place.

9 Claims, 2 Drawing Figures

NMOS VOLTAGE REFERENCE GENERATOR

BACKGROUND OF THE INVENTION

1. Field of the Invention

This invention relates generally to voltage regulator circuits, and more particularly, to an NMOS voltage reference generator employing a differential amplifier and suitable for application in integrated circuits.

2. Description of the Prior Art

The advantages offered by NMOS technology are well known; e.g., higher density, greater yield, etc. Thus smaller NMOS device geometries permit a greater number of devices to be produced per unit area or, stated another way, a single NMOS device will occupy less space. This characteristic is extremely important in the design and fabrication of complex digital integrated circuits; for example, single chip microprocessors.

Whereas digital circuitry is generally characterized by its "ON/OFF" or "ONE/ZERO" nature, most measurements in the real world are inherently analog; e.g., temperature, pressure, speed, voltage, etc. Therefore, it is often necessary that digital circuitry communicate or interface with analog circuitry. The required interfacing may be accomplished by providing analog components which are external to the chip; however, such arrangement generally requires more current, a larger power supply and commonly present more opportunities for design and manufacturing errors. To avoid these disadvantages, complex analog circuits are being manufactured integrally with the digital circuitry; e.g., on the integrated circuit chip itself, and due to the complex nature of the digital circuitry, the inclusion of the analog devices on the same chip requires that the same manufacturing process be employed.

It is often necessary to generate a voltage with which digital logic signals may be compared in order to determine their state. Since, for example, TTL logical zero levels are generally at or above threshold for a 5 volt NMOS circuit, it is necessary to create a reference voltage of about 1.5 volts to compare to the logic levels.

Circuits are known which are capable of generating a reference voltage which varies directly with the device threshold voltage. One such circuit is shown and described in U.S. Pat. No. 3,806,742 issued Apr. 23, 1974 and assigned to the assignee of the present invention.

SUMMARY OF THE INVENTION

It is an object of the present invention to provide an improved NMOS voltage reference generator.

It is a further object of the invention to provide an NMOS voltage reference generator which regulates to a fixed voltage.

It is a still further object of the invention to provide an NMOS voltage reference generator which presents a relatively low output impedance to a capacitive load.

According to a broad aspect of the invention there is provided an MOS voltage regulating circuit for generating a stable reference voltage between ground and a source potential, comprising: a voltage divider coupled to said source potential for dividing said source potential down to a first voltage; a differential amplifier comprised of field effect transistors, said differential amplifier having inverting and non-inverting inputs and a non-inverting output, said non-inverting input coupled to said voltage divider for receiving therefrom said first voltage, said stable reference voltage appearing at said inverting input; feedback means coupled to said non-inverting output and to said inverting input for raising the voltage at said inverting input to said reference voltage; and voltage pull-down means coupled to said feedback means and to said inverting input for reducing the voltage at said inverting input to said reference voltage.

The above and other objects, features and advantages of the present invention will be more clearly understood from the following detailed description taken in conjunction with the accompanying drawings, in which:

DESCRIPTION OF THE PREFERRED EMBODIMENT

Figure 1:
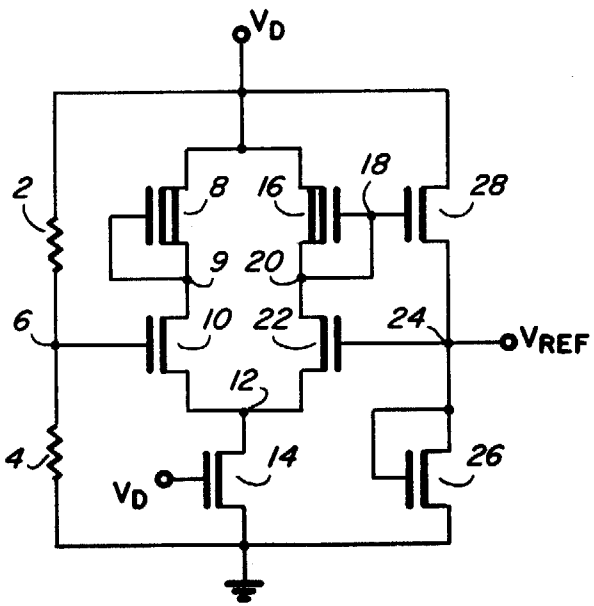
FIG. 1 is a schematic diagram of a first embodiment of the inventive voltage reference generator.

Referring to FIG. 1, there is shown a reference voltage generating circuit in accordance with the present invention, including a resistive voltage divider, a differential amplifier and an output feedback stage. The resistive divider comprises resistors 2 and 4 coupled in series between ground and a source of supply voltage $V_D$ and having an output node 6. With $V_D$ equal to 5 volts, a voltage at output node 6 of 1.5 volts may be achieved by properly scaling resistors 2 and 4.

A differential amplifier comprises MOSFETs 8, 10, 14, 16 and 22 having non-inverting and inverting inputs coupled to nodes 6 and 24 respectively, and having inverting and non-inverting outputs at nodes 9 and 20 respectively. MOSFETs 8 and 16 are of the depletion type, and MOSFETs 10, 22 and 14 are of the enhancement type. It should be noted that in the art, the acronym MOSFET is widely used to include within the scope of its meaning, all insulated gate field effect transistors, and this is the intended meaning of the term as used herein in the description of this invention. It should be recognized by those skilled in the art that a MOSFET may be of the P-channel type or N-channel type. While it is assumed herein that N-channel MOSFETs are used, it should be understood that P-channel MOSFETs may also be used. It is also well-known that a MOSFET is a bilateral device having two main electrodes which may interchangeably function as source or drain electrodes depending on which is at the more positive voltage. The convention adopted for the description herein is that the main electrodes will each be identified as either a source or drain although it is understood that during circuit operation any electrode identified as a source may function as a drain part of the time.

MOSFETs 8 and 10 are coupled with their source drain paths in series between the source of supply voltage $V_D$ and node 12. The gate of depletion MOSFET 8 is coupled to its source (the inverting output) and the gate of MOSFET 10 is coupled to node 6 (the non-inverting input). MOSFETs 16 and 22 are likewise coupled with their source drain paths in series between the source of supply voltage $V_D$ and node 12. The gate of MOSFET 16 is coupled to its source (the non-inverting output), and the gate of MOSFET 22 is coupled to node 24 (the inverting input) from which the reference voltage $V_{Ref}$ is taken. MOSFET 28 is of the enhancement type and functions as a source follower with its gate coupled to the gate of device 16 and to node 20. Its source is coupled to node 24, and its drain is coupled to the supply voltage $V_D$. MOSFET 26 is also of the enhancement type and is coupled as a diode with its gate tied to its drain. MOSFET 26 acts as a DC load to ground to assure that device 28 remains in the active region. MOSFET 14 has its source-drain path coupled between ground and node 12, and has its gate electrode coupled to the source of supply $V_D$.

The circuit of FIG. 1 operates as follows. Resistors 2 and 4 are scaled to produce a voltage at node 6 of approximately 3/10ths $V_D$ or 1.5 volts. Thus, to balance of differential amplifier, a voltage of approximately 1.5 volts appears at the gate of device 22 which is the inverting input of the differential amplifier. If the voltage at node 24 should fall below the 1.5 volt level, MOSFET 22 will begin to turn off raising the voltage at node 20 (the non-inverting output). This in turn causes device MOSFET 28 to turn on harder thus pulling node 24 back up to the 1.5 volt level. If, on the other hand, the voltage at node 24 should rise above 1.5 volts, thus increasing the gate drive to MOSFET 22, MOSFET 22 will turn on harder reducing the voltage at node 20 which tends to shut down MOSFET 28. The current through diode connected MOSFET 26 will increase pulling the voltage at node 24 back down.

MOSFET 14 having its gate coupled to the supply voltage $V_D$ acts as a current source and also assists in compensating for power supply variation. Since the current through device 14 is essentially linear with respect to $V_D$, raising $V_D$ will increase the current through device 14 and correspondingly through devices 8 and 16. The result is an increased voltage drop across device 16 which lowers the voltages at nodes 18 and 24 with respect to $V_D$. This will minimize the effect of the power supply variation at node 24.

The circuit shown as FIG. 1 can be further improved by eliminating device 8 entirely and tying the drain of MOSFET 10 directly to the supply voltage $V_D$. In this manner, MOSFET 10 is always in saturation and is not subject to current variation as a result of channel length modulation.

Figure 2:
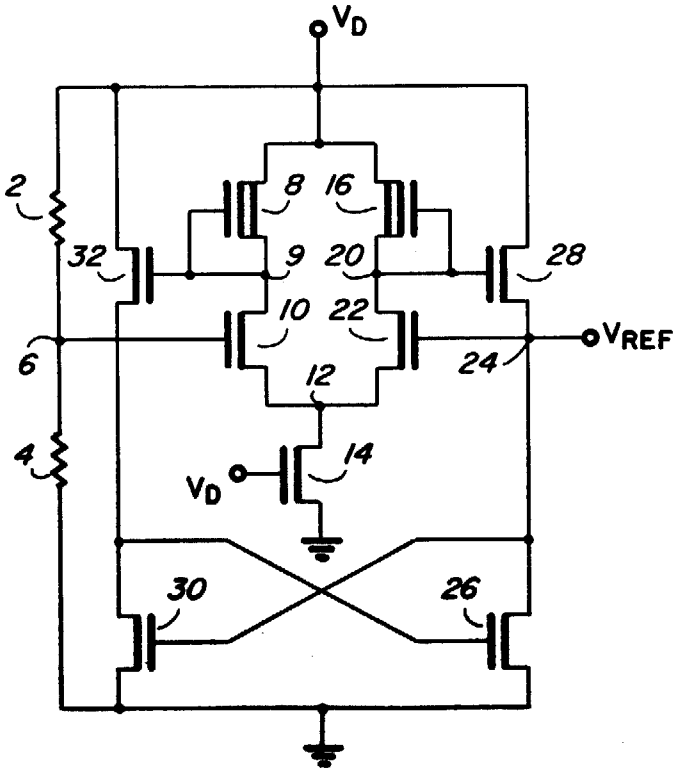
FIG. 2 is a schematic diagram of a second embodiment of the inventive reference voltage generator.

The circuit shown in FIG. 2 is a modified version of the circuit shown in FIG. 1 and produces a faster return to the reference voltage after a positive excursion. In this circuit, enhancement device 26 is not diode connected but is cross-connected with an additional enhancement device 30. That is, the drain of MOSFET 26 is coupled to the gate of MOSFET 30, and the gate of MOSFET 30 is coupled to the drain of MOSFET 26. The sources of both MOSFETs 26 and 30 are coupled to ground. An additional device 32 has a drain coupled to the supply voltage $V_D$, a gate coupled to node 9, and a source coupled to the drain of device 30 and to the gate of device 26. All other elements are the same as that shown in FIG. 1 and are denoted with like reference numerals.

During a positive excursion of the reference voltage at node 24, device 22 is turned on harder reducing the voltage of node 20. The voltage at node 9 increases turning device 32 on harder. This increases the gate voltage of device 26 causing it to turn on harder, thus pulling the reference voltage back down to 1.5 volts.

In summary, the present invention provides an MOS reference voltage generator circuit which provides a low impedance output and offers some compensation for power supply variation. While the invention has been shown in connection with specific embodiments thereof, it will be apparent to those skilled in the art that various changes in form and details may be made without departing from the spirit and scope of the invention as defined by the appended claims.

I claim:

1. An MOS voltage regulating circuit for generating a stable reference voltage between ground and a source potential, comprising:

a voltage divider coupled to said source potential for dividing said source potential down to a first voltage;

a differential amplifier comprised of field effect transistors, said differential amplifier having inverting and non-inverting inputs and inverting and non-inverting outputs, and non-inverting input coupled to said voltage divider for receiving therefrom said first voltage, said stable reference voltage appearing at said inverting input;

feedback means coupled to said non-inverting output and to said inverting input for raising the voltage at said inverting input to said reference voltage; and voltage pull-down means coupled to said feedback means and to said inverting input for reducing the voltage at said inverting input to said reference voltage, said voltage pull-down means comprising:

a first field effect transistor having source, drain and gate electrodes, the source electrode of said first transistor coupled to ground and the drain electrode of said first transistor coupled to said inverting input;

a second field effect transistor having source, drain and gate electrodes, the source electrode of said second field effect transistor coupled to ground, the drain electrode of said second transistor coupled to the gate electrode of said first transistor and the gate electrode of said second transistor coupled to the drain electrode of said first transistor; and a third field effect transistor having source, drain and gate electrodes, the source electrode of said third transistor coupled to the gate electrode of said first transistor, the drain electrode of said third transistor coupled to said source potential and the gate electrode of said third transistor coupled to said inverting output.

2. A circuit according to claim 1 wherein said feedback means comprises a fourth field effect transistor having source, drain and gate electrodes, said drain electrode coupled to said source potential, said source electrode coupled to said inverting input and said gate electrode coupled to said non-inverting output.

3. A circuit according to claim 2 wherein said differential amplifier comprises:

fifth and sixth source-coupled field effect transistors each having source, drain and gate electrodes, the gate electrode of said fifth transistor coupled to said non-inverting input and the gate electrode of said sixth transistor coupled to said inverting input; and seventh and eighth field effect transistors each having source, drain and gate electrodes, the drain electrodes of said seventh and eighth transistors coupled to said source potential the gate electrode of said seventh transistor coupled to the source electrode of said seventh transistor and to the drain electrode of said fifth transistor, and the gate electrode of said eighth transistor coupled to the source electrode of said eighth transistor and to the drain electrode of said sixth transistor.

4. A circuit according to claim 3 further including a ninth field effect transistor having a drain electrode coupled to the source electrodes of said fifth and sixth transistors, having a source electrode coupled to ground and having a gate electrode coupled to said source potential.

5. A circuit according to claim 4 wherein said fifth, sixth and ninth transistors are of the enhancement type and wherein said seventh and eighth transistors are of the depletion type.

6. A circuit according to claim 2 wherein said differential amplifier comprises:

fifth and sixth source-coupled field effect transistors each having source, drain and gate electrodes, the gate electrode of said fifth transistor coupled to said non-inverting input and the drain electrode of said fifth transistor coupled to said source potential, the gate electrode of said sixth transistor coupled to said inverting input and the drain electrode of said sixth transistor coupled to the non-inverting output; and a seventh transistor having a drain electrode coupled to said source potential, a gate electrode coupled to said non-inverting output and a source electrode coupled to said non-inverting output.

7. A circuit according to claim 6 further including an eighth transistor having a drain electrode coupled to a source electrode of said fifth and sixth transistors, a source electrode coupled to ground and a gate electrode coupled to said source potential.

8. A circuit according to claim 7 wherein said seventh transistor is of the depletion type and wherein said fifth, sixth and eighth transistors are of the enhancement type.

9. A circuit according to claim 2 wherein said voltage divider comprises first and second resistors are series coupled between said source potential and ground, the junction of said first and second resistors coupled to said non-inverting input.

* * * * *